United States Patent [19]

Sauder

[11] 4,097,100

[45] Jun. 27, 1978

[54] PANEL ASSEMBLY

[75] Inventor: Myrl Sauder, Archbold, Ohio

[73] Assignee: Sauder Woodworking Co., Archbold, Ohio

[21] Appl. No.: 760,648

[22] Filed: Jan. 19, 1977

[51] Int. Cl.[2] ..... A47B 43/00

[52] U.S. Cl. ..... 312/257 A; 312/204; 52/316

[58] Field of Search ..... 312/257 A, 204, 245; 52/316, 313, 457, 458; D25/48; 40/152, 158 R, 158 A

[56] References Cited

U.S. PATENT DOCUMENTS

| | | | |
|---|---|---|---|
| 467,063 | 1/1892 | Sword | 52/316 |
| 517,521 | 4/1894 | Hensel | 52/316 |
| 1,094,709 | 4/1914 | Faucett | 40/152 |
| 2,035,964 | 3/1936 | Hormes | 52/313 |
| 3,011,222 | 12/1961 | Spiselman | 52/457 |
| 3,263,357 | 8/1966 | Carleton | 40/152 |
| 3,498,001 | 3/1970 | MacDonald | 52/316 |
| 3,570,160 | 3/1971 | Spertus | 40/152 |
| 3,731,444 | 5/1973 | Tobin | 52/316 |
| 3,953,951 | 5/1976 | Bushee | 52/457 |
| 4,008,551 | 2/1977 | MacDonald et al. | 52/316 |

FOREIGN PATENT DOCUMENTS

| | | | |
|---|---|---|---|
| 156,251 | 5/1922 | United Kingdom | 52/316 |

*Primary Examiner*—Paul R. Gilliam
*Assistant Examiner*—Victor N. Sakran
*Attorney, Agent, or Firm*—Richard D. Emch

[57] ABSTRACT

The invention disclosed relates to raised or lowered panel assemblies, such as raised panel doors, as employed in cabinets and furniture. The frame is constructed of pre-shaped molding having an inner section of reverse taper and an integral thicker outer section. The frame is comprised of four pieces of molding assembled as stiles and rails of the door and joined at mitered corners. The molding is rabbeted along the inner edge and receives a flat center panel formed with a projecting tongue or groove and lip.

The molding and center panel are preferably formed having a core composite of wood composition or chip board. The core is wrapped or covered with a surface layer of a plastic, preferably thermosetting, material which simulates a wood veneer.

8 Claims, 5 Drawing Figures

PANEL ASSEMBLY

BACKGROUND OF THE INVENTION

The invention relates to a panel assembly, and more particularly to a "raised" or "lowered" panel door as used in cabinets and furniture having a full veneer surface or facsimile.

In the manufacture of raised panel doors, a perimeter frame is fabricated from vertical stiles and horizontal rails. A center panel is tapered around its edges to give a raised effect. A rabbet joint connects the center panel to the inside edge of the frame. This construction has been practiced for solid wood doors; however, more recently doors have been constructed of an inexpensive and dimensionally stable core material overlaid with a wood veneer layer, a plastic laminate or other type of surface veneering material. In such construction raised panel doors have been costly and difficult to construct. A veneered center panel which has the taper machined around the edges to give the "raised" effect of necessity cuts into the core material which is of different composition and appearance than the thin layer of surface veneer. This requires special treatment of exposed core material to give it the same appearance as the surface veneer. This is costly and time-consuming.

Another approach to making raised panel doors is shown in U.S. Pat. No. 3,731,444 in which a center panel is surrounded by four inner border members tapered outwardly from the panel. This inner border is fastened to four outer border members. A flat support backing is fastened to the underside of the assembly. This gives the appearance of a raised panel door; however, the central panel is actually flush with the four outer border members which form in effect the stiles and rails for the door.

SUMMARY OF THE INVENTION

The present invention provides a simplified construction for making "raised panel" or "lowered panel" assemblies, particularly raised panel door assemblies, utilizing composition or chip board core material and a thin surface layer of wood or plastic veneer.

The raised panel door incorporates the raised tapered section in the frame of the door, i.e., the stiles and rails, by forming them from pre-shaped molding. This molding is formed with a reverse tapered section along one longitudinal portion that is rabbeted and an integral regular shaped section is disposed along the outer portion. The panel is formed from a flat sheet and complementarily shaped to be received by the rabbeted edge of the molding pieces cut to size for the stiles and rails of the door. The rabbet may be defined by either the molding or the center panel.

The assembly permits use of a lower cost, flat panel as the raised panel. The molding which is shaped of the core material is easily and more economically wrapped with the finish veneer.

Joining the molding to the panel may be accomplished for producing either a raised or lowered panel effect, as desired, by the thickness of the panel piece, and location and style of rabbeting provided along the interface connection between the edge of the taper section of the molding and the external edges of the panel, as described more particularly hereinafter.

By joining the frame of the molding to the panel and by mitering the corners of the four frame pieces, a strong veneered raised panel door assembly is produced. The door has the pleasing appearance of a solid door. Cost and manufacturing of the door is reduced and simplified.

As will be apparent from the following detailed description, several further embodiments, modifications and advantages of the invention may occur to those skilled in the art.

DETAILED DESCRIPTION OF THE INVENTION

Figure 1:
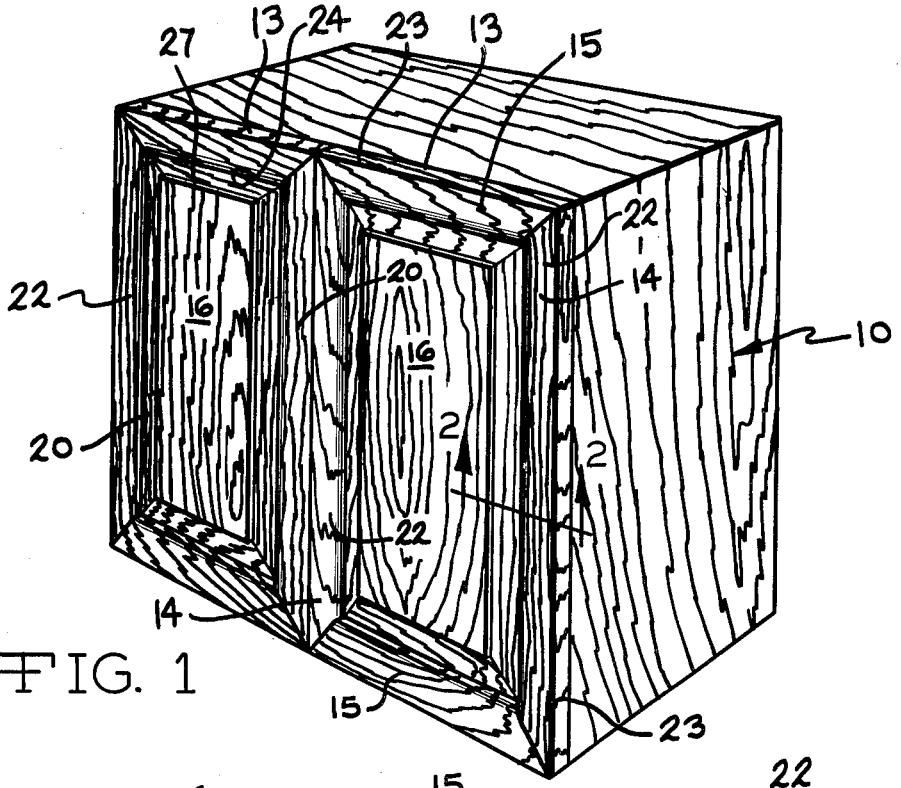
FIG. 1 is a front perspective view of an article of furniture including a raised center panel door according to the present invention.

As shown in FIG. 1, an article of furniture 10 is fabricated from material that comprises a cellulose fiber core 11 (FIG. 2) and a surface laminate layer 12. The core 11 is preferably selected from a medium density fiberboard, composition board, particle board, chipboard or wood product of dimensional stability. The thickness of pieces selected for the furniture article 10 are well known to those skilled in the industry.

The laminate 12 may be one of several such laminate products used presently, including but not necessarily limited to polyester thermosetting plastics, vinyl plastic films, wood veneer, or composite laminates.

The furniture article 10 includes a pair of raised outer panel doors 13, each constructed of four frame pieces. The frame pieces are arranged as opposed stiles 14 and opposed rails 15, each mitered and fastened at their ends. A flat center panel 16 is positioned with the frame defined by the pieces 14-15. An inner facing straight edge 17 of each of the members 14, 15 includes a rabbet 18 (FIG. 2) and the panel 16 includes a matching straight edge 21 having a tongue 19 depending outwardly therefrom at right angles. The tongue 19 enters the rabbet 18 of each of members 14, 15 in the door assembly.

Figure 2:
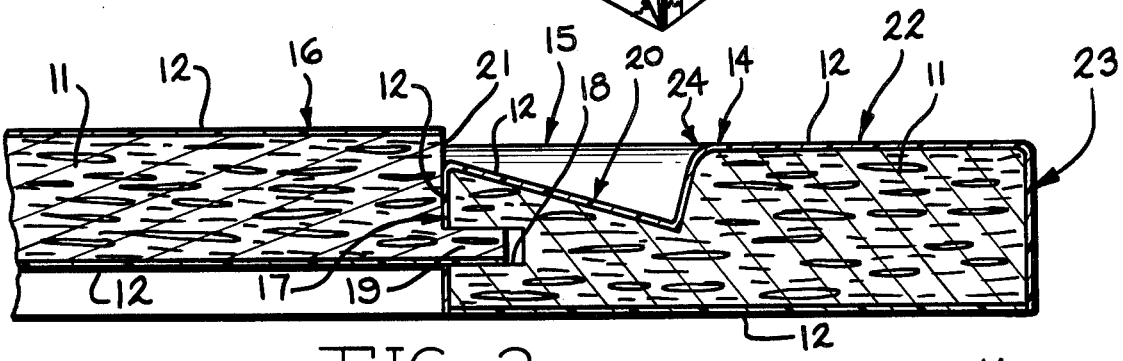
FIG. 2 is a cross-sectional view taken along Line 2—2 of FIG. 1, and shwon on an enlarged scale.

As shown in FIG. 2, the cross section of the frame members, namely stiles 14 or rails 15, is an integral piece comprised of the core 11 and wrapped with a surface lamina 12, the latter being adhesively or otherwise attached to core 11. The frame member is a shaped one-piece molding having an inner longitudinal portion comprising a reverse taper portion 20. An inner longitudinal edge 21 of the portion 20 has a straight surface that is the thickest section of the portion 20. The portion 20 tapers inwardly to a thinnest section where it merges or blends smoothly into an outside portion 22 of the frame members 14, 15. The portion 22 is of somewhat regular shape having flat facing and rear surfaces parallel to each other. An outside edge 23 of the outside portion 22 is disposed at right angles with these parallel faces. The inner facing surface of the outside portion 22 includes a radius corner 24 and an inner sloped face which blends with the near surface of the inner, thinner section of the reverse taper portion 20.

In the raised center panel embodiment of FIG. 2, the thickness of panel 16 and location of rabbet 18 positions the outer face of the panel in raised relation to the frame members 14, 15 surrounding it. A small portion of edge 21 of panel 16 extends above the top of edge 17 of the frame member 15. At least this much of the edge surface 21 protruding above this inner corner of the frame member 15 is stained or covered to match the veneer or surface layer 12.

Figure 4:
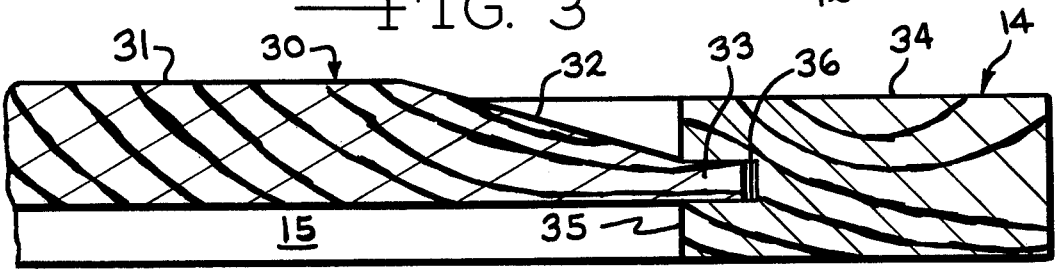
FIG. 4 (PRIOR ART)
FIG. 4 is a sectional view similar to FIG. 2, illustrating the prior art construction of a solid wood, raised center panel door.

By contrast, the conventional construction of a solid wood raised panel door is shown in FIG. 4. The center panel 30 is made by shaping a solid block of wood to form the flat outer face 31 centrally of the panel 30 and a tapering marginal segment 32 adjacent the face 31. The tapered segment 32 terminates in a tongue segment 33 which is at the perimeter of the panel 30. The frame member 34 is a solid wood piece of generally rectangular configuration. An inner edge 35 of the frame member 34 is rabbeted at 36 to receive the tongue 33.

Figure 3:
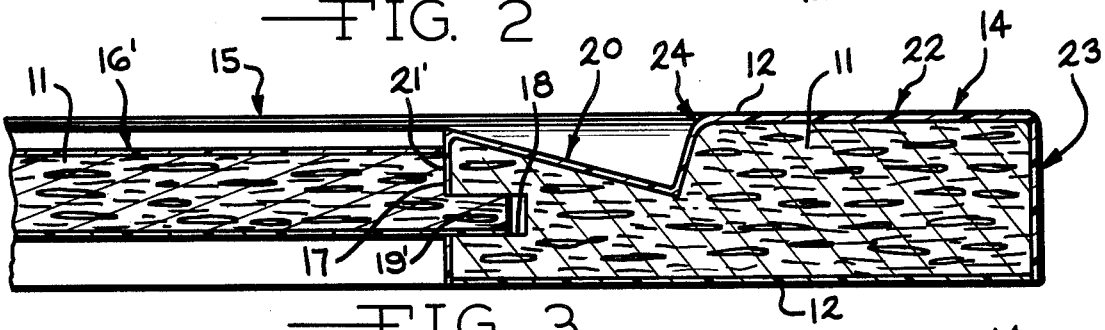
FIG. 3 is a sectional view similar to FIG. 2 showing a lowered center panel door assembly according to the present invention.

A lowered center panel embodiment is shown at FIG. 3. The frame members 14,15 are constructed as described earlier. The center panel 16' is similarly made from a thinner piece of flat core stock 11 laminated at its opposite surfaces with the covering layer 12. By virtue of the thickness dimension selected for the center panel 16', the top corner of the edge 21' of the panel meets the inner edge surface 17 of the frame member in a lowered plane, thereby providing a lowered center panel appearance. Panel 16' is received along the perimeter at tongue 19' in the rabbet 18 of the frame members 14, 15.

Thus, by selection of the thickness of material in the center panel (16 or 16') and utilizing the same tongue-in-groove assembly (18, 19 or 19'), the unit may be made as a "raised center panel" assembly or "lowered center panel" assembly.

Figure 5:
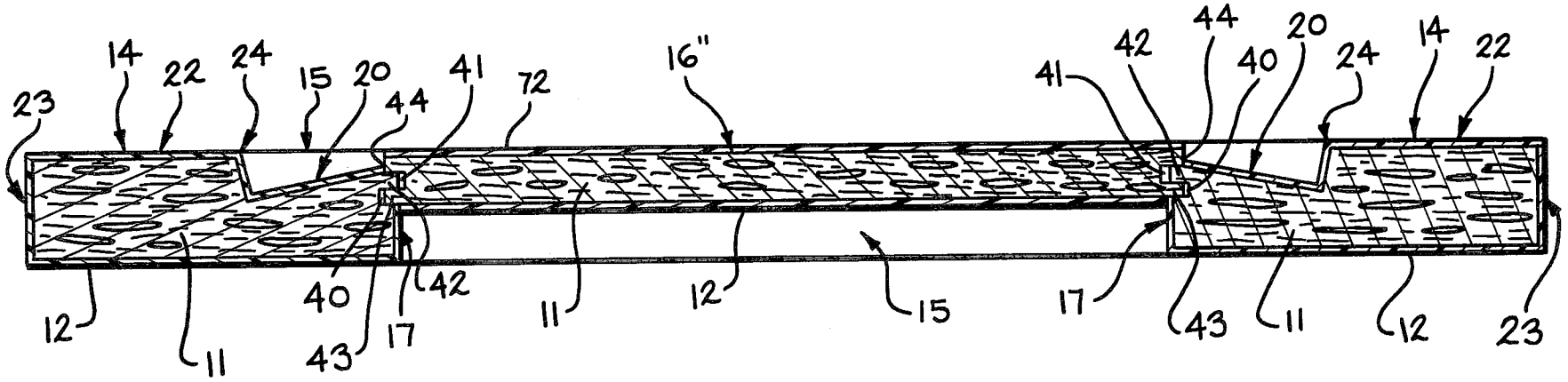
FIG. 5 is a cross-sectional view of a preferred embodiment of the invention showing a pseudo raised center panel door having a double rabbeted joint for connecting the panel to the frame.

Referring now to FIG. 5, a still further embodiment of the invention is shown. The frame members 14, 15 are constructed from the same core material 11 and wrapped with a decorative surface layer 12 in the same manner. In this instance, a rabbet 40 is milled longitudinally along the edge surface 17 of each of the members 14, 15. The center panel 16'' in this embodiment is again formed from a flat piece of the core 11 and surface laminated on opposite faces with layers 12. Instead of a perimeter tongue, in the present embodiment, the piece 16'' is provided with a matching rabbet 41 around its periphery. The width of rabbet 41 is made to match the thickness of an upper ledge 42 above the rabbet 40 of the inner edge surface 17 of the frame members (14, 15) of the door. In this manner, the upper ledge 42 is received in the rabbet 41 of the panel 16'' and a lower ledge 43 of the panel 16'' is received by the rabbet 40 of the frame members 14, 15. This embodiment, therefore, utilizes matching offset interlocking rabbets 40, 41. By selection of the thickness of the panel 16'', the front face of the panel may, in fact, be raised or, as in the example shown in FIG. 5, may be substantially flush with the front face of the outer portion 22 of the frame forming a pseudo raised panel assembly.

A top lateral edge 44 of the center panel 16'' may include a laminated layer 12 extending down to the rabbet 41. In the alternative, the exposed edge 44 of the panel 16'' may be stained to match.

The stock for the frame members 14, 15 may be manufactured as a molding shaped from the core material and wrapped or overlaid with a thin decorative laminate of the materials mentioned above. The composite shaped molding is processed by milling the longitudinal groove or rabbets in accordance with one of the foregoing embodiments. The frame member pieces which form the stiles and rails are cut to length and are preferably beveled at their ends to form mitered corner joints.

The center panels are made from a flat sheet of core material laminated on opposite faces thereof with thin surface layers. A full dimensioned piece is cut from the sheet inclusive of the protruding tongue segment or, in the case of FIG. 5, the groove segment. The tongue or groove is shaped at the perimeter of this sized piece and if needed any edge exposure stained. The center panels are now ready for assembly.

The door is formed by assembling two stiles and one rail, for example, in the shape of a U-frame. The mitered corners are secured by adhesive or other known means. The center panel is next fitted with the U-shaped frame assembly by sliding two opposed tongues (or in the case of FIG. 5, a lip 43) into the rabbets of the parallel frame members, in this example the stiles, until the one end tongue (or lip) thereof seats in a rabbet of the transverse frame member, in this example, the one rail. The other transverse member (rail) is then placed over the open end of the U-shaped frame causing the tongue (or lip) of the panel at that adjacent side thereof to seat in its rabbet. This peripherally frames the center panel with the fitted stiles and rails. The miter joints at the corners may then be secured such as by adhesive, steel clamps, nails or the like. Other forms of corner joints may be employed; however, mitered corner joints are preferred.

The materials described herein for making the assembly in accordance with the invention, such as the composition board or chipboard core and thin surface laminates of plastic materials herein described, are preferred for their dimensional stability against warping or the like, as compared to prior art solid wood raised panel assemblies. Such construction is better suited to withstand moisture and humidity variations. This is especially significant for cabinets in service in kitchens. Utilizing flat center panels made from a core and sheet laminate provides an economical means to form this type of decorative raised panel door, and also provides an improved door with respect to dimensional stability.

Having described the invention in some detail with respect to several embodiments thereof, including a preferred embodiment, other and further modifications and variants of the invention will occur to those skilled in the art and which can be effected within the spirit and scope of the invention, as described hereinabove, and as defined in the appended claims.

I claim:

1. A panel assembly comprising, a center panel of a core material having a thin layer attached to at least one surface thereof, four frame members next to the sides of said center panel, each of said four frame members including an inner reverse taper portion and an integral outer portion, said inner reverse taper portion having a thicker section disposed adjacent said center panel and a thinner portion adjacent said integral outer portion, each of said four frame members comprising a core material having a thin surface layer attached to at least one surface thereof, said four frame members having abutting and connected ends forming a four sided frame, said four sided frame defining a continuous connector means on its inner periphery, the outer periphery of said center panel defining mating means received by said continuous connector means for securing and holding said center panel in a self supporting relationship, relative to said four sided frame, said continuous connector means and said mating means comprising at least one continuous groove and at least one projection received by said groove.

2. The panel assembly of claim 1 in which the center panel is of a thickness so as to be in a raised relationship with the face of said outer portion of four sided frame.

3. The panel assembly of claim 1 in which the center panel is of a thickness so as to be in a lowered relationship with the face of said outer portion of four sided frame.

4. The panel assembly of claim 1 in which the face of the center panel lies substantially in the plane of the face of said outer portion of said four sided frame.

5. The panel assembly of claim 1 in which said continuous connector means comprises a continuous groove defined by said frame and said mating means comprises a continuous projection on said center panel, said groove engaging said projection.

6. The panel assembly of claim 1 in which said continuous connector means and said mating means include a first groove defined on said inner periphery of said frame, a second groove defined by said outer periphery of said center panel, a first projection on said center panel received by said first groove and a second projection on said frame received by said second groove.

7. The panel assembly of claim 1, in which said frame members are connected to one another by mitered joints.

8. A panel door assembly comprising, a center panel of a core material having a thin layer attached to at least one surface thereof, four frame members next to the sides of said center panel, each of said four frame members including an inner reverse taper portion and an integral outer portion, said inner reverse taper portion having a thicker section disposed adjacent said center panel and a thinner portion adjacent said integral outer portion, each of said four frame members comprising a core material having a thin surface layer attached to at least one surface thereof, said four frame members having abutting joints forming a four sided frame, said four sided frame defining a continuous connector means on its inner periphery, the outer periphery of said center panel defining mating means complementary with said continuous connector means for securing and holding said center panel in a self supporting relationship, relative to said four sided frame, said continuous connector means and said mating means including a first rabbet defined on said inner periphery of said frame, a second rabbet defined by said outer periphery of said center panel, a first projection on said center panel received by said first rabbet and a second projection on said frame received by said second rabbet.

* * * * *